US009984615B2

(12) United States Patent
Hu

(10) Patent No.: US 9,984,615 B2
(45) Date of Patent: May 29, 2018

(54) PIXEL DRIVING CIRCUIT, DRIVING METHOD, ARRAY SUBSTRATE AND DISPLAY DEVICE ENSURING LUMINANCE UNIFORMITY OF LIGHT-EMITTING DEVICE

(71) Applicants: BOE TECHNOLOGY GROUP CO., LTD., Beijing (CN); HEFEI XINSHENG OPTOELECTRONICS TECHNOLOGY CO., LTD., Heifei, Anhui Province (CN)

(72) Inventor: Zuquan Hu, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 95 days.

(21) Appl. No.: 14/594,317

(22) Filed: Jan. 12, 2015

(65) Prior Publication Data

US 2016/0189604 A1 Jun. 30, 2016

(30) Foreign Application Priority Data

Dec. 29, 2014 (CN) ..... 2014 1 0835003

(51) Int. Cl.
*G09G 3/32* (2016.01)
*G09G 3/3225* (2016.01)

(52) U.S. Cl.
CPC ... *G09G 3/3225* (2013.01); *G09G 2300/0814* (2013.01); *G09G 2300/0819* (2013.01); *G09G 2320/045* (2013.01)

(58) Field of Classification Search
None
See application file for complete search history.

(56) References Cited

U.S. PATENT DOCUMENTS 8,253,665 B2 * 8/2012 Nathan ..... G09G 3/3233 315/169.1
8,547,369 B2 * 10/2013 Kim ..... G09G 3/3233 345/209

(Continued)

FOREIGN PATENT DOCUMENTS

CN 1700287 A 11/2005
CN 1720567 A 1/2006

(Continued)

OTHER PUBLICATIONS

First Chinese Office Action dated May 3, 2016; Appln. No. 201410835003.7.

(Continued)

*Primary Examiner* — William Boddie
*Assistant Examiner* — Bipin Gyawali
(74) *Attorney, Agent, or Firm* — Ladas & Parry LLP; Loren K. Thompson

(57) ABSTRACT

There is provided a pixel driving circuit, a driving method, an array substrate and a display device. The pixel driving circuit comprises: a first switching unit, being turned on or off according to a first scanning signal to control a transmission of a data signal; a first charging unit, having first terminal connected to a second terminal of the first switching unit; a first driving unit, having control terminal connected to a second terminal of the first charging unit, first terminal connected to a first power supply, and second terminal connected to a second power supply; a first driving compensation unit, for producing a predetermined voltage at the control terminal of the first driving unit, so that a current flowing through the light-emitting device is independent of threshold voltage of the first driving unit. Accordingly, the threshold voltage is prevented from affecting light-emitting luminance, luminance uniformity is ensured.

15 Claims, 8 Drawing Sheets

(56) References Cited

U.S. PATENT DOCUMENTS

2005/0174311 A1* 8/2005 Huh ..... G09G 3/3233 345/87
2005/0259703 A1* 11/2005 You ..... G09G 3/3233 372/38.07
2006/0248420 A1 11/2006 Jeong
2008/0284691 A1* 11/2008 Chung ..... G09G 3/3291 345/76
2009/0273546 A1* 11/2009 Kim ..... G09G 3/3233 345/76
2012/0327064 A1* 12/2012 Qi ..... G09G 3/32 345/212
2013/0050292 A1* 2/2013 Mizukoshi ..... G09G 3/3291 345/690
2015/0060896 A1* 3/2015 Okano ..... G09G 3/3225 257/88
2015/0179105 A1* 6/2015 Mizukoshi ..... G09G 3/3266 345/76
2015/0364087 A1* 12/2015 Gu ..... G09G 3/3233 345/78
2016/0204165 A1* 7/2016 Yang ..... H01L 27/323 345/174
2016/0224157 A1* 8/2016 Yang ..... G06F 3/0416

FOREIGN PATENT DOCUMENTS

CN 1742308 A 3/2006
CN 101937647 A 1/2011
CN 102682704 A 9/2012
CN 103077677 A 5/2013
CN 103700346 A 4/2014
CN 203689881 U 7/2014

OTHER PUBLICATIONS second Chinese Office Action dated Nov. 3, 2016; Appln. No. 201410835003.7.

* cited by examiner

PIXEL DRIVING CIRCUIT, DRIVING METHOD, ARRAY SUBSTRATE AND DISPLAY DEVICE ENSURING LUMINANCE UNIFORMITY OF LIGHT-EMITTING DEVICE

This application claims the benefit under 35 U.S.C. § 119(a) of Chinese Patent Application No. 201410835003.7, filed on Dec. 29, 2014, the entire disclosures of which are incorporated herein by references for all purposes.

TECHNICAL FIELD

The present disclosure relates to a field of display technique, in particular to a pixel driving circuit, a driving method, an array substrate and a display device.

BACKGROUND

With a progressive development of display technique, a light-emitting diode (LED) display panel gradually comes into the market, typically comprising an active matrix organic light-emitting diode (AMOLED). Compared with a traditional liquid crystal display (LED) technique, AMOLED display has a faster response speed, a higher contrast ratio and a broader angle of view and does not need any backlight unit. Therefore, AMOLED display is considered as a next generation of display technique. In AMOLED, a light-emitting display is an organic light-emitting diode (OLED). Under a driving of an AMOLED driving circuit, OLED emits light when there is current flowing through the light-emitting device.

Pixel driving circuit of AMOLED generally adopts a 2T1C driving circuit which comprises two thin film transistors (TFT) and one capacitor. One TFT is configured to control writing of a data line voltage Vdata and is called as a switching TFT, the other TFT is configured to control an operating state of OLED and is called as a driving TFT, and the capacitor C is configured to maintain a strobe electrode voltage of the other TFT.

In the 2T1C driving circuit, a threshold voltage of the driving TFT will drift as the display operates for a long time, while light-emitting luminance of OLED is closely related with the threshold voltage. Therefore, a change of the threshold voltage of the driving TFT will greatly influence the light-emitting luminance of OLED. That is, the change of the threshold voltage of the driving TFT will influence luminance uniformity of OLED. In addition, in the process of OLED operation, the driving TFT always keeps in a turn-on state. A long time of operation will reduce lifetime of the driving TFT, and thus reduce lifetime of the OLED display panel.

Therefore, it is desired to improve the driving circuit for driving OLED, so as to solve one or more of the problems described above. That is, it is desired to avoid an effect of the threshold voltage of the driving TFT on the light-emitting luminance of OLED, or to increase lifetime of the driving TFT.

SUMMARY

The present disclosure provides a pixel driving circuit, a driving method, an array substrate and a display device, which is capable of preventing a threshold voltage of a driving unit from influencing light-emitting luminance of a light-emitting device, so as to guarantee luminance uniformity of the light-emitting device.

According to a first aspect, there is provided a pixel driving circuit comprising a first driving component. The first driving component may comprises: a first switching unit, having a control terminal and a first terminal which are connected to a first scanning control line and a first data line respectively, and being configured to be turned on or turned off according to a first scanning signal in the first scanning control line to control a transmission of a data signal in the first data line; a first charging unit, having a first terminal which is connected to a second terminal of the first switching unit; a first driving unit, having a control terminal connected to a second terminal of the first charging unit, a first terminal connected to a first power supply through the light-emitting device, and a second terminal connected to a second power supply, a voltage of the first power supply being greater than a voltage of the second power supply, and the first driving unit being disabled when a voltage at the control terminal of the first driving unit is smaller than a threshold voltage; and a first driving compensation unit, connected to the control terminal of the first driving unit and configured to produce a predetermined voltage at the control terminal of the first driving unit when the first scanning signal in the first scanning control line turns on the first switching unit, so that, after a data signal that enables to emit light is received from the first data line, a current flowing through the light-emitting device is independent of the threshold voltage of the first driving unit by means of the predetermined voltage.

By combining with the first aspect, in one implementation of the first aspect, the first driving compensation unit may comprise: a first transistor, having a strobe electrode connected to the first scanning control line, a first electrode and a second electrode which are connected to a first terminal and a second terminal of the light-emitting device respectively; a second transistor, having strobe electrode connected to a first control line, a first electrode connected to the second terminal of the light-emitting device, and a second electrode connected to a first electrode of the first driving unit; and a third transistor, having a strobe electrode connected to a second control line, a first electrode connected to a second terminal of the second transistor, and a second electrode connected to the control terminal of the first driving unit.

By combining with the first aspect and the implementation described above, in another implementation of the first aspect, the first switching unit may comprise a first switching transistor, first switching transistor having a strobe electrode connected to the first scanning control line, a first electrode connected to the first data line, and a second electrode connected to the first terminal of the first charging unit.

By combining with the first aspect and the implementation described above, in another implementation of the first aspect, the first driving unit may comprise a first driving transistor, the first driving transistor having a strobe electrode connected to a second terminal of the first charging unit, a first electrode connected to the first power supply through the light-emitting device, and a second electrode connected to the second power supply.

By combining with the first aspect and the implementation described above, in another implementation of the first aspect, the pixel driving circuit may further comprise a second driving component and a switch-over unit. The second driving component may comprise: a second switching unit, having a control terminal and a first terminal which are connected to a second scanning control line and a second data line respectively and being configured to be turned on or turned off according to a second scanning signal in the second scanning control line to control a transmission of the data signal of the second data line; a second charging unit, having a first terminal connected to a second terminal of the second switching unit; a second driving unit, having a control terminal connected to a second terminal of the second charging unit, first terminal connected to the first power supply via the light-emitting device, and a second terminal connected to the second power supply; and a second driving compensation unit, connected to the control terminal of the second driving unit, for producing a predetermined voltage at the control terminal of the second driving unit when the second scanning signal in the second scanning control line turns on the second switching unit, so that, after a data signal that enables to emit light is received from the second data line, the current flowing through the light-emitting device is independent of the threshold voltage of the second driving unit by means of the predetermined voltage. The switch-over unit may be connected to the first driving component and the second driving component, and may be configured to select one of the first driving component and the second driving component to drive the light-emitting device to emit light.

By combining with the first aspect and the implementation described above, in another implementation of the first aspect, the second driving compensation unit may comprise: a fourth transistor, having a strobe electrode connected to the second scanning control line, a first electrode and second electrode which are connected to the first terminal and the second terminal of the light-emitting device respectively; and a fifth transistor, having a strobe electrode connected to a third control line, a first electrode connected to the second terminal of the second transistor, and a second electrode connected to the control terminal of the second driving unit. The second driving component and the second transistor may cooperate to drive the light-emitting device.

By combining with the first aspect and the implementation described above, in another implementation of the first aspect, the switch-over unit may comprise: a first switch-over transistor, having a strobe electrode connected to a first switch-over control line, a first electrode connected to the strobe electrode of the first driving transistor, and a second electrode connected to the second power supply; and a second switch-over transistor, having a strobe electrode connected to a second switch-over control line, a first electrode connected to a strobe electrode of the second driving transistor, and a second electrode connected to the second power supply.

By combining with the first aspect and the implementation described above, in another implementation of the first aspect, the first driving component may drive the light-emitting device to emit light in an odd frame period, and the second driving component may drive the light-emitting device to emit light in an even frame period. In the odd frame period, the first switch-over transistor may be turned off under a driving of a first switch-over control signal in the first switch-over control line, and the second switch-over transistor may be turned on under a driving of the second switch-over control signal in the second switch control line to disable the second driving transistor. In the even frame period, the first switch-over transistor may be turned on under a driving of a first switch-over control signal in the first switch-over control line, and the second switch-over transistor may be turned off under a driving of the second switch-over control signal in the second switch control line to disable the first driving transistor.

According to a second aspect, there is provided a driving method for a pixel driving circuit. The pixel driving circuit may be used for driving a light-emitting device and may comprise a first driving component. The first driving component may comprise a first switching unit, a first charging unit, a first driving unit and a first driving compensation unit. The first switching unit may have a control terminal connected to a first scanning control line, a first terminal connected to a first data line, and a second terminal connected to a first terminal of the first charging unit. The first driving unit may have a control terminal connected to a second terminal of the first charging unit, a first terminal connected to a first power supply via the light-emitting device, and a second terminal connected to a second power supply. A voltage of the first power supply may be greater than a voltage of the second power supply. The first driving compensation unit may be connected to a control terminal of the first driving unit, the first driving unit may be disabled when a voltage at the control terminal of the first driving unit is smaller than a threshold voltage. Each frame period driven by the pixel driving circuit may be divided into a first period of time, a second period of time, a third period of time and a fourth period of time in sequence. The driving method may comprise: in the first period of time, charging the first charging unit by means of the first driving compensation unit; in the second period of time, discharging the first charging unit by means of the first driving compensation unit until a predetermined voltage is produced at the control terminal of the first driving unit, the predetermined voltage including a threshold voltage component of the first driving unit; in the third period of time, the first switching unit being turned on and transmitting a level signal used for making the light-emitting device emit light and storing the level signal in the first charging unit; and in the fourth period of time, the first driving unit being turned on to form a loop for the light-emitting device so as to make the light-emitting device emit light, and the threshold voltage component in the predetermined voltage making that a current flowing through the light-emitting device is independent of the threshold voltage when the light-emitting device emits light.

By combining with the second aspect, in one implementation of the second aspect, the first driving compensation unit may comprise a first transistor, a second transistor and a third transistor. The first transistor may be connected in parallel with the light-emitting device and may have a strobe electrode connected to a first scanning control line. The second transistor may be connected in series with the light-emitting device and may have a strobe electrode connected to a first control line. The third transistor may be connected between the second transistor and a second terminal of a first capacitor, and may have a strobe electrode connected to a second control line. The charging the first charging unit by means of the first driving compensation unit in the first period of time may comprise: in the first period of time, controlling the first transistor to be turned on by a first scanning signal in the first scanning control line to form a bypass for the light-emitting device, to not make the light-emitting device emit light, controlling the second transistor and the third transistor to be turned on to charge the first charging unit by a first control signal in the first control line and a second control signal in the second control line respectively, and correspondingly turning on the first driving unit. The discharging the first charging unit by means of the first driving compensation unit in the second period of time until the predetermined voltage is produced at the control terminal of the first driving unit comprising: in the second period of time, controlling the first transistor to be continually turned on by the first scanning signal, controlling the second transistor to be turned off by the first control signal, controlling the third transistor to be continually turned on by the second control signal, and the third transistor and the first driving unit forming a loop to make the first charging unit discharge until the first driving unit is disabled, so that the predetermined voltage is produced at the control terminal of the first driving unit, the predetermined voltage being equal to a sum of the threshold voltage of the first driving unit and the voltage of the second power supply.

By combining with the second aspect and the implementation described above, in another implementation of the second aspect, the turning on the first switching unit and transmitting a level signal used for making the light-emitting device emit light and storing the level signal in the first charging unit in the third period of time may comprise: in the third period of time, controlling the first transistor and the first switching unit to be continually turned on by the first scanning signal, controlling the second transistor to be continually turned off by the first control signal, controlling the third transistor to be turned off by the second control signal, and the first data signal in the first data line changing into a high level that makes the light-emitting device emit light, and storing the high level in the first charging unit, so as to turn on the first driving unit. The turning on the first driving unit to form a loop for the light-emitting device so as to make the light-emitting device emit light in the fourth period of time may comprise: in the fourth period of time, controlling the first transistor and the first switching unit to be turned off by the first scanning signal, controlling the second transistor to be turned on by the first control signal, controlling the third transistor to be turned off by the second control signal, turning on the first driving unit until the fourth period of time ends up, and a turn-on of the first driving unit in the fourth period of time forming a loop for the light-emitting device to make the light-emitting device emit light.

By combining with the second aspect and the implementation described above, in another implementation of the second aspect, the pixel driving circuit may further comprise a second driving component and a switch-over unit. The driving method further may comprises: selecting one of the first driving component and the second driving component by using the switch-over unit; driving the light-emitting device by the first driving component when the first driving component is selected; and driving the light-emitting device by the second driving component when the second driving component is selected.

By combining with the second aspect and the implementation described above, in another implementation of the second aspect, the switch-over unit may comprise a first witch-over transistor and a second switch-over transistor. A strobe electrode of the first switch-over transistor may be connected to a first switch-over control line, a first electrode thereof may be connected to the control terminal of the first driving unit, and a second electrode thereof may be connected to the second power supply. A strobe electrode of the second switch-over transistor may be connected to a second switch-over control line, a first electrode thereof may be connected to a control terminal of the second driving unit, and a second electrode thereof may be connected to the second power supply. The selecting one of the first driving component and the second driving component by using the switch-over unit may comprise: driving the first switch-over transistor to be turned off by a first switch-over control signal in the first switch-over control line, and driving the second switch-over transistor to be turned on by the second switch-over control signal in the second switch-over control line to stop using the second driving unit, so as to select the first driving component; and driving the first switch-over transistor to be turned on by the first switch-over control signal in the first switch-over control line and driving the second switch-over transistor to be turned off by the second switch-over control signal in the second switch-over control line to stop using the first driving unit, so as to select the second driving component.

By combining with the second aspect and the implementation described above, in another implementation of the second aspect, the driving the light-emitting device by the first driving component may comprise: driving the light-emitting device by the first driving component in an odd frame period. The driving the light-emitting device by the second driving component may comprise: driving the light-emitting device by the second driving component in an even frame period.

According a third aspect, there is provided an array substrate comprising the pixel driving circuit described above.

According to a fourth aspect, there is provided a display device comprising the array substrate described above.

In the technical solutions of the pixel driving circuit, the driving method, the array substrate and the display device according to the embodiments of the present disclosure, the predetermined voltage is produced at the control terminal of the driving unit by means of the driving compensation unit, so that the current flowing through the light-emitting device is independent of the threshold voltage of the driving unit, thereby the threshold voltage of the driving unit is prevented from influencing the light-emitting luminance of the light-emitting device, luminance uniformity of the light-emitting device is guaranteed.

BRIEF DESCRIPTION OF THE DRAWINGS

In order to more clearly describe technical solutions of embodiments of the present disclosure, accompanying figures used for descriptions of the embodiments or prior art will be simply introduced below. Obviously, the figures described below are just some embodiments of the present disclosure, and other figures may be obtained from these figures by those ordinary skilled in the art without paying any inventive labor.

DETAILED DESCRIPTION

Technical solutions in embodiments of the present disclosure will be clearly and completely described in combination with the figures. Obviously, the embodiments described herein are a part of embodiments of the present disclosure rather than all the embodiments of the present disclosure.

In the present disclosure, when it is described that a specific device is arranged between a first device and a second device, there may exist an intermediary device between the specific device and the first device or between the specific device and the second device, or there may not exist any intermediary device; when it is described that a specific device is connected to other devices, the specific device may be directly connected to other devices and no intermediary device exists, or the specific device may not be directly connected to other devices and an intermediary device exists.

Figure 1:
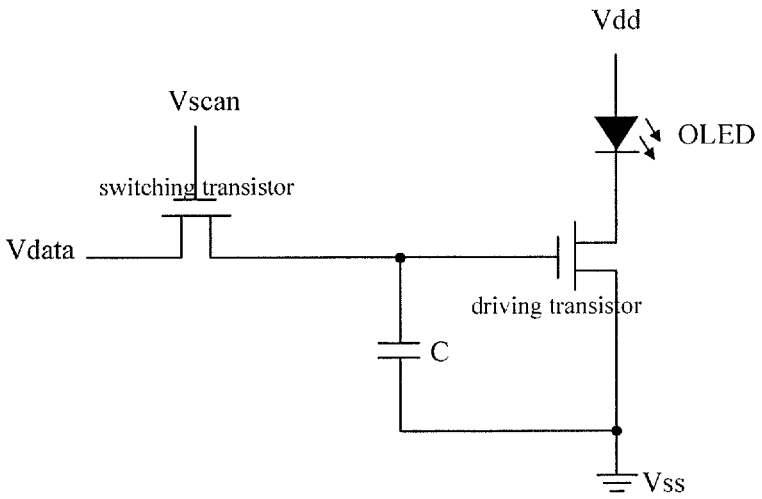
FIG. 1 schematically shows a circuit diagram of a traditional 2T1C driving circuit used for OLED.

FIG. 1 schematically shows a circuit diagram a traditional 2T1C driving circuit used for OLED. As shown in FIG. 1, the 2T1C driving circuit comprises a switching transistor, a driving transistor and a capacitor C. A scanning signal Vscan is input to a strobe electrode of the switching transistor. A data signal Vdata is input to a first electrode of the switching transistor. A second electrode of the switching transistor is connected to a first terminal of the capacitor C. The capacitor C is bridged between a strobe electrode and a second electrode of the driving transistor. A first electrode of the driving transistor is connected to a first power supply through the light-emitting device, and the second electrode thereof is connected to a second power supply. The first power supply is a power supply having a high voltage. The second power supply is a power supply having a low voltage, for example, a ground. In a thin film transistor, the strobe electrode is a gate, the first electrode is a drain, and the second electrode is a source. In a bipolar transistor, the strobe electrode is a base, the first electrode is a collector, and the second electrode is an emitter.

It will be described below by taking transistors being N type TFTs as an example. Assuming that one frame period is divided into two periods of time. In a first period of time, Vscan is at a high level, and thus the switching transistor is turned on, the high level of Vdata is written into the storage capacitor C and a gate of the driving transistor, and thus the driving transistor is turned on. Correspondingly, a cathode of the light-emitting device OLED is connected to a low level Vss, so that OLED starts to operate to emit light. In a second period of time, Vscan is in the low level, and thus the switching transistor is turned off, the driving transistor is continually turned on due to charge maintaining effect of the storage capacitor C, and OLED continues to be operated until the high level signal of Vscan comes later. When OLED emits light, the current of the light-emitting device is typically shown in Equation (1) as follows:

$$I=K(Vgs-Vth)^2 \qquad \text{Equitation (1)}$$

wherein K is a constant related to processing parameter and geometric size of the driving transistor, Vgs is a gate-source voltage of the driving transistor, and Vth is a threshold voltage of the driving transistor. The threshold voltage Vth may drift with a operating time of the display panel. According to the Equation (1) described above, it can be known that the light-emitting current will change when the threshold voltage Vth drifts, and thus the light-emitting luminance of the light-emitting device will change. That is, the change of the threshold voltage of the driving TFT will influence luminance uniformity of OLED.

In addition, it can be known from the above description that in the process of OLED operation, the driving transistor always keeps in a turn-on status. A long time of operation will reduce lifetime of the driving transistor, correspondingly reducing lifetime of the display panel.

In the embodiment of the present disclosure, a predetermined voltage is generated at the strobe electrode of the driving transistor by using a driving compensation unit, so that a current following through the light-emitting device is independent of the threshold voltage of the driving transistor. Therefore, the threshold voltage of the driving transistor is prevented from influencing the light-emitting luminance of the light-emitting device, and the luminance uniformity of the light-emitting device is guaranteed. In addition, two groups of light-emitting elements for driving the light-emitting devices are arranged and made to operate at different times, which improves that the driving transistor in the traditional pixel driving circuit is always in the turn-on status, so as to relatively increase operation lifetime of the driving transistor and further increase operation lifetime of the display panel. Embodiments of the present disclosure will be described in particular below.

Figure 2:
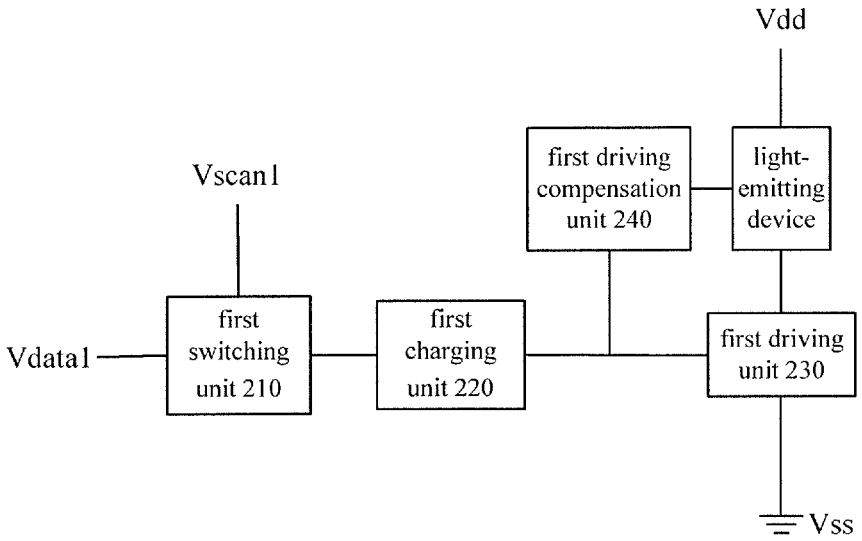
FIG. 2 is a schematic diagram of a first pixel driving circuit used for driving a light-emitting device according to an embodiment of the present disclosure.

FIG. 2 is a schematic diagram of a first pixel driving circuit used for driving a light-emitting device according to an embodiment of the present disclosure. The light-emitting device driven by the first pixel driving circuit may be any light-emitting device, and is typically an organic light-emitting diode OLED. The type of the light-emitting device does not form a limitation to the embodiment of the present disclosure.

As shown in FIG. 2, the pixel driving circuit comprises a first switching unit 210, a first charging unit 220, a first driving unit 230, a first driving compensation unit 240. The first switching unit 210 has a control terminal and a first terminal which are connected to a first scanning control line and a first data line respectively, and is configured to be turned on or turned off according to a first scanning signal Vscan1 in the first scanning control line, so as to control a transmission of a data signal Vdata1 in a first data line. The first charging unit 220 has a first terminal which is connected to a second terminal of the first switching unit 210. The first driving unit 230 has a control terminal which is connected to a second terminal of the first charging unit 220. First terminal of the first driving unit 230 is connected to a first power supply through the light-emitting device, and second terminal of the first driving unit 230 is connected to a second power supply. A voltage Vdd of the first power supply is greater than a voltage Vss of the second power supply. The first driving unit 230 is disabled when a voltage at the control terminal of the first driving unit 230 is smaller than a threshold voltage. The first driving compensation unit 240 is connected to the control terminal of the first driving unit 230 and configured to produce a predetermined voltage at the control terminal of the first driving unit 230 when the first scanning signal Vscan1 in the first scanning control line turns on the first switching unit 210. After a data signal that enables to emit light is received from the first data line, a current flowing through the light-emitting device is independent of the threshold voltage of the first driving unit 230 by means of the predetermined voltage.

Figure 3:
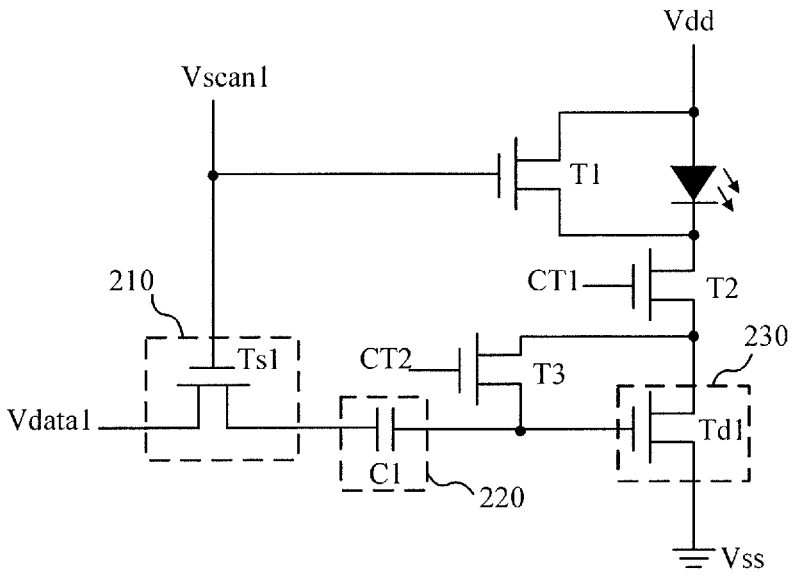
FIG. 3 is a circuit diagram of an exemplary implementation of the first pixel driving circuit according to an embodiment of the present disclosure.

The first switching unit 210 is typically constituted of one or more transistors. As an example, the first switching unit 210 is a first switching transistor Ts1 as shown in FIG. 3. A strobe electrode of the first switching transistor Ts1 is connected to the first scanning control line, a first electrode thereof is connected to the first data line, and a second electrode thereof is connected to the first terminal of the first charging unit 220. By taking the first switching transistor Ts1 being an NMOS transistor as an example, when a gate as the strobe terminal is at the high level, the NMOS transistor is turned on and transit the first scanning signal Vscan1 to the first charging unit 220; when the gate as the gate terminal is at the low level, the NMOS transistor is turned off and forbids to transmit the first scanning signal Vscan1 to the first charging unit 220.

The first charging unit 220 is typically an energy storage device, which is capable of charging and discharging. The first charging unit 220 may be a capacitor. Alternatively, the first charging unit 220 may further be an energy storage device constituted of a capacitor and an inductor. As an example, the first charging unit 220 may be a first capacitor C1 in FIG. 3. A first terminal of the first capacitor C1 is connected to the second terminal of the first switching unit, and a second terminal of the first capacitor C1 is connected to the control terminal of first driving unit 230.

The first driving unit 230 is typically constituted of one or more transistors. As an example, the first driving unit 230 may be a first driving transistor Td1 as shown in FIG. 3. A strobe electrode of the first driving transistor Td1 is the control terminal of the first driving unit 230, and is connected to the second terminal of the first charging unit 220. A first electrode of the first driving transistor Td1 is the first terminal of the first driving unit 230, and is connected to the first power supply through the light-emitting device. A second electrode of the first driving transistor Td1 is the second terminal of the first driving unit 230, and is connected to the second power supply. A voltage provided by the first power supply is VDD, and a voltage provided by the second power supply is a reference voltage VSS. The voltage provided by the first power supply may be higher than the reference voltage. The voltage VDD may be at the high level. VSS as a reference voltage may be at the low level. When the voltage at the control terminal of the first driving unit 230 is lower than a specific voltage (i.e., a threshold voltage), it is disabled and thus there is no signal flowing through. When the first driving transistor Td1 is turned on, it forms a current loop with the light-emitting device to make the light-emitting device emit light. When the first driving transistor Td1 is turned off, the light-emitting device is in an open circuit status and can not emit light.

It is described below by taking the first switching unit 210 being the first switching transistor Ts1, the first charging unit 220 being the first capacitor C1 and the first driving unit 230 being the first driving transistor Td1 as an example. This is just an example, but can not form a limitation to the embodiments of the present disclosure.

It is described below by combining with one scanning period of an image. When one scanning period of the image starts, the first scanning signal Vscan1 in the first scanning control line turns on the first switching transistor Ts1. The first driving compensation unit 240 may produce a predetermined voltage Vp at the strobe electrode of the first driving transistor Td1. As an example, the first driving compensation unit 240 comprises a compensation power supply corresponding to the threshold voltage of the first driving transistor Td1 and a compensation transistor. A compensation control signal is set for the compensation transistor, so that after the first switching transistor Ts1 is turned on, the voltage of the compensation power supply is transmitted to the strobe electrode of the first driving transistor Td1 by using the compensation transistor. Typically, the voltage of the compensation power supply may be equal to the threshold voltage of the first driving transistor Td1, or may be greater a fixed value than the threshold voltage of the first driving transistor Td1. As such, a predetermined voltage Vp produced at the strobe electrode of the first driving transistor Td1 is equal to a sum of Vth and a constant VA, so that Vth in Equation (1) may be eliminated. At this time, at the first terminal of the first capacitor C1 is a low voltage data signal VL, and at the second terminal of the first capacitor C1 is the predetermined voltage Vp (equal to Vth+VA). A voltage difference between two terminals of the first capacitor C1 is Vth+VA−VL.

After the predetermined voltage Vp is produced at the strobe electrode of the first driving transistor Td1, the compensation transistor is controlled to be turned off by using the compensation control signal. At the same time, a data signal received from the first data line changes from a low voltage VL to a high voltage VH used for enabling to emit light. The high voltage is written into the first terminal of the first capacitor, so that the voltage at the first terminal of the first capacitor C1 is VH. The voltage difference Vth+VA−VL between the two terminals of the first capacitor C1 is maintained due to a turn-off of the compensation transistor, so that the voltage (i.e., the voltage Vg at the strobe electrode of the first driving transistor Td1) at the second terminal of the first capacitor C1 is equal to Vth+VA−VL+VH.

It can be obtained Equation (2) as below by substituting the voltage Vg in the above Equation (1):

$$\begin{aligned} I &= K(Vgs - Vth)^2 \\ &= K((Vth + VA - VL + VH - Vss) - Vth)^2 \\ &= K(VH - VL + VA - Vss)^2 \end{aligned} \qquad \text{Equation (2)}$$

It can be seen from the Equation (2) that the current of the light-emitting device is independent of the threshold voltage Vth of the driving transistor Td1, and both the voltages VA and Vss in the Equation (2) are constants, so that the current of the light-emitting device may be determined according to the data signal, which is capable of maintaining a uniform light-emitting luminance.

It can be seen from the above analysis that the first driving compensating unit 240 may produce at the strobe electrode of the first driving transistor Td1 a predetermined voltage comprising the threshold voltage of the first driving transistor, and the capacitance maintaining characteristic of the first capacitor C1 is used to make the current flowing through the light-emitting device independent of the threshold voltage of the first driving transistor.

Alternatively, the first driving compensating unit 240 may further have other structure, but not use the above compensation power supply and the compensation transistor. FIG. 3 is a circuit diagram of an exemplary implementation of a first driving component according to the embodiment of the present disclosure. In FIG. 3, the same reference marks are adopted for devices the same as those in FIG. 2, and thus the devices the same as those in FIG. 2 are not described.

FIG. 3 further shows a specific implementation of the first driving compensation unit 240. As shown in FIG. 3, the first driving compensation unit 240 comprises a first transistor T1, a second transistor T2 and a third transistor T3. The first transistor T1 has a strobe electrode which is connected to the first scanning control line. First electrode and second electrode of the first transistor T1 are connected to the first terminal and the second terminal of the light-emitting device respectively. The second transistor T2 has a strobe electrode which is connected to the first control line, a first electrode which is connected to the second terminal of the light-emitting device, and a second electrode which is connected to the first electrode of the first driving transistor Td1. The third transistor T3 has a strobe electrode which is connected to the second control line, a first electrode which is connected to the second terminal of the second transistor T2, and a second electrode which is connected to the strobe electrode of the first driving transistor Td1. In the first driving compensation unit 240 in FIG. 3, a special compensation power supply is not needed, but the predetermined voltage may be produced at the strobe electrode of the first driving transistor Td1 by only using three transistors, and the current flowing through the light-emitting device is made to be independent of the threshold voltage of the first driving transistor.

Figure 4:
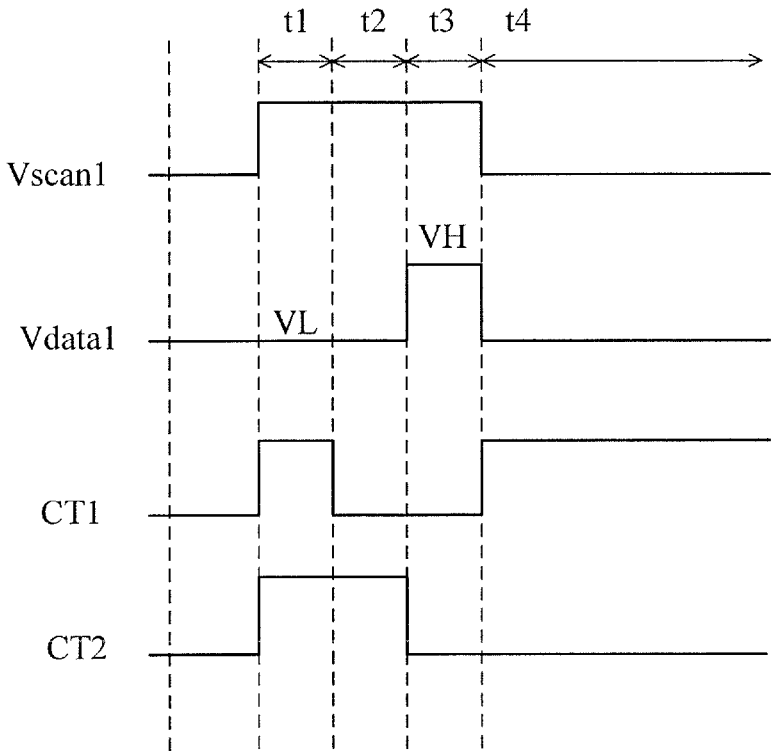
FIG. 4 schematically shows a timing diagram of the circuit diagram in FIG. 3.

FIG. 4 schematically shows a timing diagram of the circuit diagram in FIG. 3. FIG. 4 shows a driving signal in one frame period. Herein, it is described by taking an example that the transistor is turned on when the driving signal is at the high level and the transistor is turned off when the driving signal is at the low level. It shall be noted that when the transistor is of a different type, it may also be that the transistor is turned on when the driving signal is at the low level and the transistor is turned off when the driving signal is at the high level. As shown in FIG. 4, each frame period may be divided into a first period of time t1, a second period of time t2, a third period of time t3 and a fourth period of time t4.

The pixel driving circuit in FIG. 3 is operated in the first period of time t1 as follows. The first scanning signal Vscan1 in the first scanning control line is at the high level, and thus the first switching transistor Ts1 is turned on and the first transistor T1 is turned on. The first control signal CT1 in the first control line is at the high level, and the second transistor T2 is turned on. The second control signal CT2 in the second control line is at the high level, and thus the third transistor T3 is turned on. The turn-on of the first transistor T1 forms a short circuit for the light-emitting device. Since the second transistor T2 and the third transistor T3 are turned on, the level Vdd of the first power supply is supplied to the gate of the first driving transistor Td1 (i.e., the second terminal of the capacitor), and thus the first driving transistor Td1 is turned on and charges the first capacitor C1, and such charging makes the voltage at the second terminal of the capacitor equal to Vdd. Since the first switching transistor Ts1 is turned on, the low level VL of the first data signal Vdata1 in the first data line is written into the first terminal of the capacitor, so that the voltage at the first terminal of the capacitor is VL. In FIG. 4, the first data signal Vdata1 having the high level VH represents a data signal that makes the light-emitting device emit light, and the first data signal Vdata1 having the low level VL is a reference signal. Therefore, in the first period of time t1, the first transistor, the second transistor and the third transistor in the first driving compensation unit 240 are turned on, and the first capacitor C1 is charged by the voltage of the first power supply. That is, the first period of time t1 is a charging stage in which the first capacitor C1 is charged.

The pixel driving circuit in FIG. 3 is operated in the second period of time t2 as follows. The first control signal CT1 is at the low level, and thus the second transistor T2 is turned off. The second control signal CT2 is at the high level, and thus the third transistor T3 is continually turned on. The third transistor T3 and the first driving transistor TD1 form a discharge circuit, so that the voltage at the second terminal of the capacitor reduces from Vdd until the voltage is equal to Vth+Vss. The Vth+Vss is the predetermined voltage Vp. When the voltage (i.e., the gate voltage Vg of the first driving transistor Td1) at the second terminal of the capacitor is equal to Vth+Vss, the first driving transistor Td1 is turned off and stops discharging. Since the first scanning signal Vscan1 is at the high level, the first transistor T1 is turned on and OLED is continually a short circuit and in a non-operation status. Since the first scanning signal Scan1 is at the high level, the first switching transistor Ts1 is continually turned on and the voltage at the first terminal of the first capacitor C1 is VL. The voltage difference between the two terminals of the first capacitor C1 is Vc1=Vth+Vss−VL. Therefore, in the second period of time, in the first driving compensation unit 240, the second transistor is turned off, the third transistor and the first driving transistor are turned on, so as to make the first capacitor discharge until the first driving transistor is turned off, so that the predetermined voltage Vp is produced at the strobe electrode of the first driving transistor. The predetermined voltage Vp is equal to the sum of the threshold voltage Vth of the first driving transistor and the voltage Vss of the second power supply. The second period of time t2 is a discharging stage in which the first capacitor C1 is discharged.

The pixel driving circuit in FIG. 3 is operated in the third period of time t3 as follows. The first control signal CT1 is at the low level, and thus the second transistor T2 is turned off. The second control signal CT2 is at the low level, and thus the third transistor T3 is turned off. The second terminal of the first capacitor C1 is in a suspension state. The first scanning signal Vscan1 is at the high level, and thus the first transistor T1 is turned on, the light-emitting device is continually the short circuit and in the non-operation state. The high level VH of the first data signal Vdata1 is written into the first terminal of the first capacitor C1, so that its voltage value is VII. Since the second terminal of the first capacitor C1 is in the suspension state, the voltage difference between the two terminals of the first capacitor C1 is the same as that in the second period of time and is equal to Vc1=Vth+Vss−VL. At this time, the voltage at the gate of the first driving transistor Td1 may be represented as the following Equation (3):

$$Vg=Vc1+VH=Vth+Vss-VL+VH=VH-VL+Vth+Vss \quad \text{Equation (3).}$$

Correspondingly, the first driving transistor Td1 is turned on. In the third period of time, respective transistors in the first driving compensation unit 240 cooperate with the first switching transistor to write the high level VH of the first data signal Vdata1 into the first terminal of the first capacitor C1, so as to adjust the voltage at the strobe electrode of the first driving transistor. The third period of time is a voltage adjusting stage in which the voltage is adjusted.

The pixel driving circuit in FIG. 3 is operated in the fourth period of time t4 as follows. In the fourth period of time T4, the first control signal CT1 is at the high level, and thus the second transistor T2 is turned on. The first scanning signal Vscan1 is at the low level, and thus the first switching transistor Ts1 and the first transistor T1 are turned on. The voltage at the first terminal of the first capacitor C1 is maintained as VH. The second control signal CT2 is at the low level, the third transistor T3 is turned on, and thus the voltage at the second terminal of the first capacitor C1 is maintained, i.e., the voltage at the gate of the first driving transistor Td1 as shown in Equation (3). At this time, the first driving transistor Td1 is continually turned on and forms a path for the light-emitting together with the second driving transistor T2 to make the light-emitting device emit light. The current flowing through the light-emitting device as shown in the following Equation (4) is obtained by substituting the Equation (3) into the Equation (1):

$$I=K(VH-VL)2 \quad \text{Equation (4).}$$

It can be seen from Equation (4) that the current flowing through the light-emitting device is independent of the threshold voltage of the first driving transistor Td1, so as to guarantee uniformity of the light-emitting luminance. Therefore, in the fourth period of time, the path is formed with the turn-on second transistor, the light-emitting device emits light, and the threshold voltage component in the predetermined voltage (for example, Vth+Vss) makes that the current flowing through the light-emitting device is independent of the threshold voltage when the light-emitting device emits light. The fourth period of time is a driving display period in which a path is formed for the light-emitting device for display.

It can be known according to the above description that the light-emitting device does not emit light in the first period of time, the second period of time and the third period of time, and emits light in the fourth period of time for display. A sum of the first period of time, the second period of time and the third period of time is short relative to the the fourth period of time, and is typically less than resolution time of the human eyes, thereby a display effect of data is not affected. For example, By taking a pixel resolution of 1920×1080 as an example, a duration time of one frame (i.e., a sum of four periods of time including the first period of time to the fourth period of time) is 16.67 ms, while the sum of the first period of time, the second period of time and the third period of time is 15.4 μs. When the next frame period starts, operations in the above four periods of time are repeated.

In the above technical solution of the pixel driving circuit according to the embodiment of the present disclosure, a predetermined voltage is produced at the control terminal of the driving unit by using the driving compensation unit, so that the current flowing through the light-emitting device is independent of the threshold voltage of the driving unit. Accordingly, the threshold voltage of the driving unit is prevented from affecting the light-emitting luminance of the light-emitting device and luminance uniformity of the light-emitting device is guaranteed.

In addition, two groups of different driving components may be arranged for the light-emitting device and the light-emitting device is driven at different times by using the two groups of driving components, so as to reduce operation time of the driving transistor in each driving component, which thus may increase operation lifetime of the driving transistors and correspondingly increase operation lifetime of the display panel.

Units or transistors as shown in FIG. 2 or FIG. 3 may constitute a driving component, and another driving component may further be arranged on such a basis. As an example, on the basis of the driving component of the pixel driving circuit as shown in FIG. 2, the pixel driving circuit used for the light-emitting device may comprise a second driving component and a switch-over unit. The second driving component may also drive the light-emitting component to emit light. The switch-over unit is connected to the first driving component and the second driving component, and one of the first driving component and the second driving component may be selected to drive the light-emitting device to emit light. In particular, on the basis of the driving component of the pixel driving circuit as shown in FIG. 2, the pixel driving circuit according to the embodiment of the present disclosure further comprises a second driving component and a switch-over unit. The second driving component comprises sections corresponding to that in the first driving component in FIG. 2. That is, the second driving component comprises a second switching unit, a second charging unit, a second driving unit and a second driving compensating unit corresponding to the first switching unit, the first charging unit, the first driving unit and the first driving compensating unit respectively.

Figure 5:
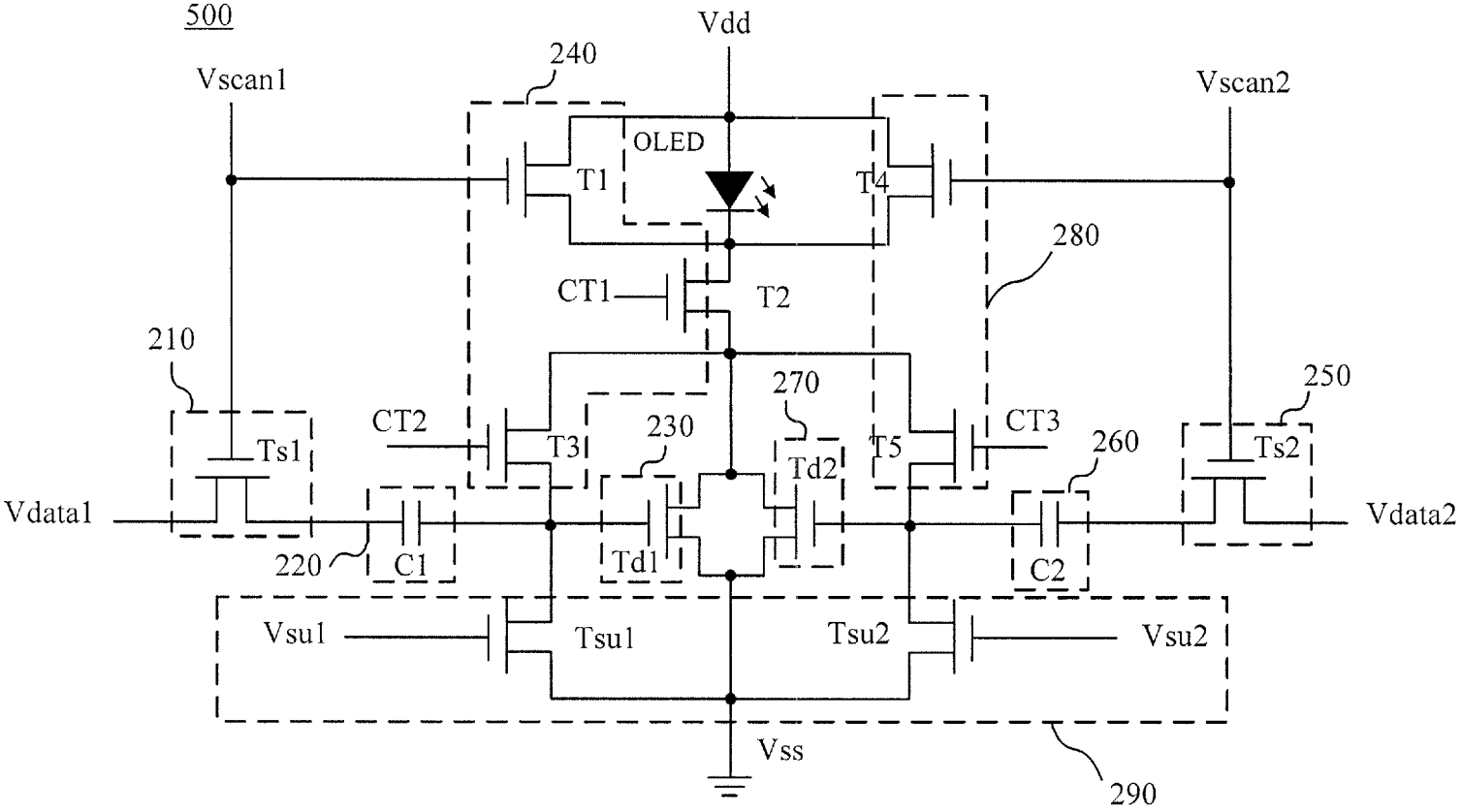
FIG. 5 is a circuit diagram of a second pixel driving circuit for driving a light-emitting device according to an embodiment of the present disclosure.

FIG. 5 is a circuit diagram of a second pixel driving circuit 500 for driving a light-emitting device according to an embodiment of the present disclosure. The second pixel driving circuit 500 comprises two driving components. In FIG. 5, devices or units the same as those in FIG. 3 are labeled with the same reference marks, and thus no further description is given herein. Compared with FIG. 3, FIG. 5 differs in adding some devices or units. The added adding devices or units constitutes the second driving component configured to drive the light-emitting device and the switch-over unit configured to select one of the first driving component and the second driving component.

In addition to the devices as shown in FIG. 3, the second pixel driving circuit 500 as shown in FIG. 5 further comprises the second driving component. The second driving component includes a second switching unit 250, a second charging unit 260, a second driving unit 270 and a second driving compensation unit 280. The second switching unit 250 has control terminal and first terminal which are connected to a second scanning control and a second data line respectively, and is configured to be turned on or turned off according to a second scanning signal Vscan2 in the second scanning control line to control a transmission of a data signal Vdata2 in the second data line. The second charging unit 260 has first terminal which is connected with the second terminal of the second switching unit. The second driving unit 270 has a control terminal which is connected to the second terminal of the second charging unit, a first terminal which is connected to the first power supply through the light-emitting device, and a second electrode which is connected to the second power supply. The second driving compensation unit 280 is connected to the control terminal of the second driving unit and is configured to produce a predetermined voltage at the control terminal of the second driving unit when the second scanning signal in the second scanning control line turns on the second switching unit, so that, after a data signal that enables to emit light is received from the second data line, a current flowing through the light-emitting device is independent of the threshold voltage of the second driving unit by means of the predetermined voltage.

Functions and implementations of the second switching unit 250, the second charging unit 260 and the second driving unit 270 may be reference to descriptions of the first switching unit 210, the first charging unit 220 and the first driving unit 230 above.

The following text will describe by taking the second switching unit 250 being a second switching transistor Ts2, the second charging unit 260 being a second capacitor C2, and the second driving unit 270 being a second driving transistor Td2 as an example. It is just an example, but cannot form a limitation to the embodiment of the present disclosure.

As shown in FIG. 5, a strobe electrode of the second switching transistor Ts2 is connected to the second scanning control line, and a first electrode thereof is connected to the second data line. A first terminal of the second capacitor C2 is connected to a second electrode of the second switching transistor Ts2. A strobe electrode of the second driving transistor Td2 is connected to a second terminal of the second capacitor C2, a first electrode thereof is connected to the first power supply through the light-emitting device, and a second electrode thereof is connected to the second power supply. The second driving compensation unit 280 is connected to the strobe electrode of the second driving transistor Td2 and is configured to produce the predetermined voltage at the control terminal of the second driving transistor Td2 when the second scanning signal Vscan2 in the second scanning control line turns on the second switching transistor. Therefore, after a data signal that enables to emit light is received from the second data line, a current flowing through the light-emitting device is independent of the threshold voltage of the second driving transistor Td2 by means of the predetermined voltage.

Further, as shown in FIG. 5, the second driving compensation unit 280 may comprise a fourth transistor T4 and a fifth transistor T5. The fourth transistor T4 has a strobe electrode which is connected to the second scanning control line, and has first electrode and second electrode which are connected to the first terminal and the second terminal of the light-emitting device respectively. The fifth transistor T5 has a strobe electrode which is connected to a third control line, a first electrode which is connected to the second terminal of the second transistor T2, and a second electrode which is connected to the strobe electrode of the second driving transistor. The fourth transistor T4 and the fifth transistor T5 in the second driving compensation unit 280 correspond to the first transistor T1 and the third transistor T3 constituting the first driving compensation unit 240 in FIG. 3 respectively. The second driving component in FIG. 5 does not include a transistor corresponding to the second transistor in the first driving component, because the second driving component and the first driving component share the second transistor. The second driving component and the second transistor T2 can independently drive the light-emitting device. Alternatively, the second driving compensation unit 280 in the second driving component may also comprise a transistor corresponding to the second transistor in the first driving component, and its connecting manner and control signal used are the same as those of the second transistor.

As an example, a switch-over unit 290 in the second pixel driving circuit 500 as shown in FIG. 5 may comprise a first switch-over transistor Tsc1 and a second switch-over transistor Tsc2. The first switch-over transistor Tsc1 has a strobe electrode which is connected to a first switch-over control line, a first electrode which is connected to the strobe electrode of the first driving transistor Td1, and a second electrode which is connected to the second power supply. The second switch-over transistor Tsc2 has a strobe electrode which is connected to a second switch-over control line, a first electrode which is connected to the strobe electrode of the second driving transistor Td2, and a second electrode which is connected to the second power supply. In one frame period, when the first driving component operates, a first switch-over control signal Vsc1 in the first switch-over control line turns off the first switch-over transistor Tsc1, and a second switch-over control signal Vsc2 in the second switch-over control line turns on the second switch-over transistor Tsc2. The turn-on of the second switch transistor Tsc2 enables that the strobe electrode of the second driving transistor Td2 is connected to the second power supply having a low level, so that the second driving transistor Td2 is turned off and does not operate, and thus the second driving component does not operate. The structure of the switch-over unit 290 as shown in FIG. 5 is just exemplary, and other structures and devices may be adopted according to the requirements to perform a switch-over control, so as to select one of the first driving component and the second driving component to drive the light-emitting device.

Figure 6:
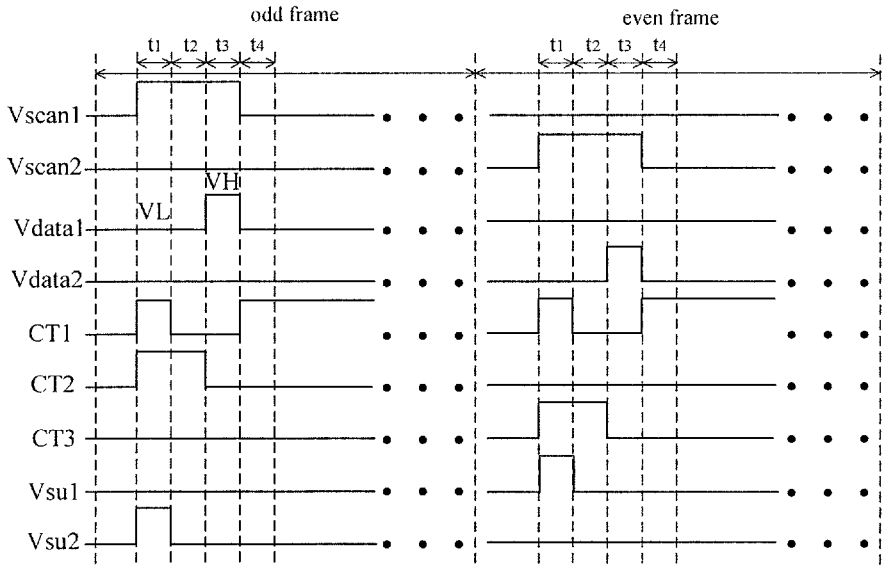
FIG. 6 schematically shows a timing diagram of the circuit diagram in FIG. 5.

FIG. 6 schematically shows a timing diagram of the circuit diagram in FIG. 5. In FIG. 6, the first driving component comprising the first switching transistor, the first driving transistor and so on in FIG. 5 is configured to drive the light-emitting in an odd frame, while the second driving component comprising the second switching transistor, the second driving transistor and so on in FIG. 5 is configured to drive the light-emitting device in an even frame.

In the odd frame, timing of the first scanning signal Vscan1, the first data signal Vdata1, the first control signal CT1 and the second control signal CT2 is the same as that in FIG. 4, and operations of transistors in the first driving component are also the same as those described by combining with FIGS. 3 and 4, and thus no further description is given herein.

In the odd frame, the second scanning signal Vscan2, the second data signal Vdata2, and the third control signal CT3 are at the low level, and thus the second switching transistor, the fourth transistor and the fifth transistor in the second driving component are turned off. In the switch-over unit 290, the first switch-over control signal Vsu1 in the first switch-over control line is at the low level, and thus the first switch-over transistor Tsu1 is made to be turned off, and the second switch-over control signal Vsu2 in the second switch-over control signal makes the second switch-over transistor Tsu2 on in the first period of time t1, and makes the second switch-over transistor Tsu2 off in the subsequent three periods of time. The turn-on of the second switch-over transistor Tsu2 enables that the gate of the second driving transistor Td2 is connected to VSS and the second driving transistor Td2 is turned off, and thus the second driving transistor Td2 is maintained to be turned off in the subsequent three periods of time. It can be seen that in the odd frame, the first switch-over transistor is turned off under driving of the first switch-over control signal in the first switch-over control line, and the second switch-over transistor is turned on under driving of the second switch-over control signal in the second switch-over control line to disable the second driving transistor, so that the second driving transistor in the second driving component does not operate while the first driving component operates normally to drive the light-emitting device.

In the even frame, the second driving component operates, while the first driving component does not operate. In the even frame, the second scanning signal Vcan2, the second data signal Vdata2, the first control signal CT1 and the third control signal CT3 used in the second driving component have the similar timing as the first scanning signal Vscan1, the first data signal Vdata1, the first control signal CT1 and the second control signal CT2 in the odd frame respectively. Operations of transistors in the second driving component are also the same as operations of transistors in the first driving component described above by combing with FIGS. 3 and 4, and thus no description is given herein.

In the even frame, the first scanning signal Vscan1, the first data signal Vdata1, and the second control signal CT2 are at the low level, and thus the first switching transistor, the first transistor, and the third transistor in the first driving component are turned off. In the switch-over unit 290, the second switch-over control signal Vsu2 in the second switch-over control line is at the low level, and thus the second switch-over transistor Tsu2 is turned off, and the first switch-over control signal Vsu1 in the first switch-over control line makes the first switch-over transistor Tsu1 on in the first period of time t1, and makes the first switch-over transistor Tsu1 off in the subsequent three periods of time.

The turn-on of the first switch-over transistor Tsu1 in the first period of time enables that the gate of the first driving transistor Td1 is connected to VSS and the first driving transistor Td1 is turned off, and the first driving transistor Td1 is maintained to be turned off in the subsequent three periods of time. It can be seen that in the even frame, the first switch-over transistor is turned on under driving of the first switch-over control signal in the first switch-over control line, and the second switch-over transistor is turned off under driving of the second switch-over control signal in the second switch-over control line, so that the first driving transistor in the first driving component does not operate, while the second driving component operates normally to drive the light-emitting device.

It shall be noted that the first driving component drives the light-emitting device in the odd frame, while the second driving component drives the light-emitting device in the even frame, which is just an example. Alternatively, one of the first driving component and the second driving component may be alternately made to operate in other kind of manner. For example, it may be that the first driving component operates on a first day while the second driving component operates on a second day, which alternates successively. The timings of the first switch-over control signal Vsu1 and the second switch-over control signal Vsu2 in the switch-over unit 290 are changed accordingly.

It can be known according to the description by combining with FIGS. 5 and 6 that operation time for the driving unit in each deriving component may be reduced by arranging two groups of different driving components for the light-emitting device and using the two groups of the driving components at different time to drive the light-emitting device. Therefore, operation lifetime of the driving unit may increase, and correspondingly operation lifetime of the display panel may increase.

Figure 7:
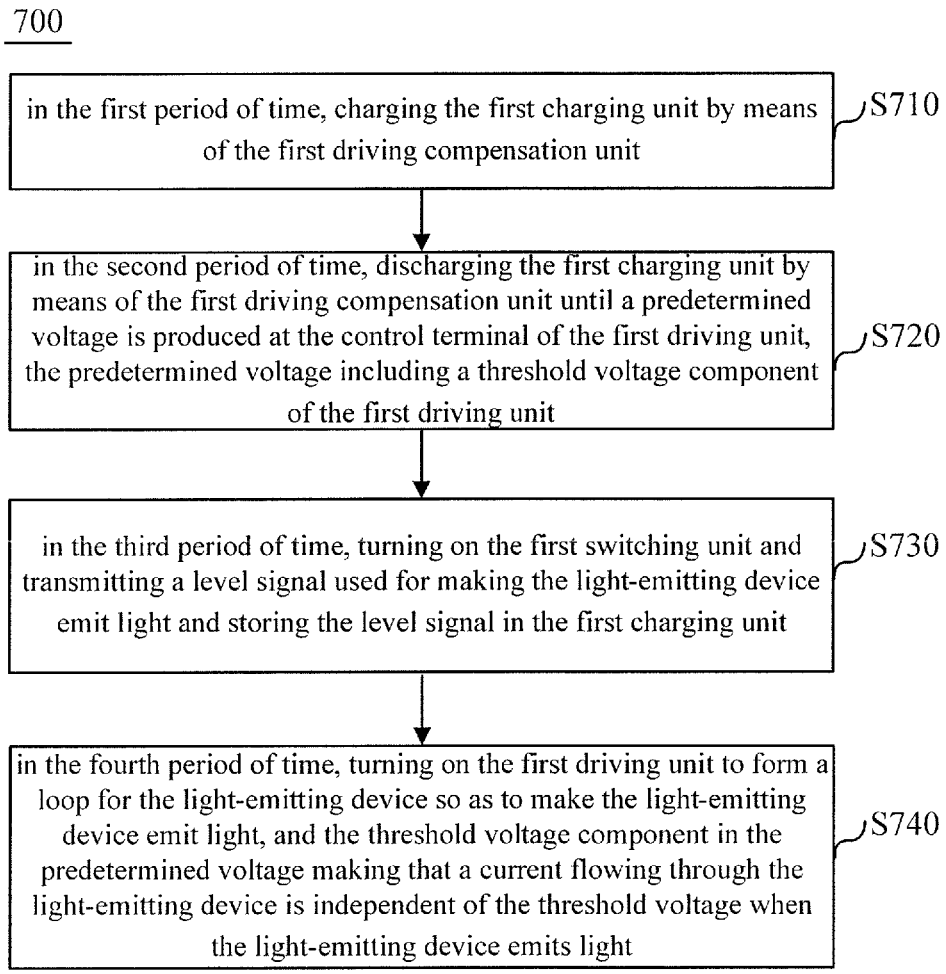
FIG. 7 is a flow diagram of a driving method for driving a light-emitting device according to an embodiment of the present disclosure.

FIG. 7 is a flow diagram of a driving method 700 for driving a light-emitting device according to an embodiment of the present disclosure. The driving method 700 may be applied to the pixel driving circuit as shown in FIG. 2. The pixel driving circuit is configured to drive a light-emitting device and comprises a first driving component. The first driving component comprises: a first switching unit, a first charging unit, a first driving unit and a first driving compensation unit. The first switching unit has a control terminal connected to a first scanning control line, a first terminal connected to a first data line, and a second terminal connected to a first terminal of the first charging unit. The first driving unit has a control terminal connected to a second terminal of the first charging unit, a first terminal connected to a first power supply through the light-emitting device, and a second terminal connected to a second power supply. A voltage of the first power supply is greater than a voltage of the second power supply. The first driving compensation unit is connected to a control terminal of the first driving unit. The first driving unit is disabled when a voltage at the control terminal of the first driving unit is smaller than a threshold voltage. The light-emitting device driven may be any light-emitting device, and is typically an organic light-emitting diode OLED. The type of the light-emitting device does not form a limitation to the driving method of the embodiment of the present disclosure. The first driving component may have a circuit structure as shown in FIG. 2 or a circuit structure as shown in FIG. 3, and thus no description is given herein. The driving method will be described below by combining with the circuit structure as shown in FIG. 3.

Each frame period driven by the pixel driving circuit is divided into a first period of time, a second period of time, a third period of time and a fourth period of time in sequence. As shown in FIG. 7, the driving method comprises: in the first period of time, charging the first charging unit by using the first driving compensation unit (S710); in the second period of time, discharging the first charging unit by using the first driving compensation unit until a predetermined voltage is produced at the control terminal of the first driving unit, the predetermined voltage including a threshold voltage component of the first driving unit (S720); in the third period of time, the first switching unit is turned on, transmits a level signal used for making the light-emitting device emit light and stores the level signal in the first charging unit (S730); in the fourth period of time, the first driving unit is turned on to form a loop for the light-emitting device so as to make the light-emitting device emit light, and the threshold voltage component in the predetermined voltage makes that a current flowing through the light-emitting device is independent of the threshold voltage when the light-emitting device emits light (S740).

The driving method is described with respect to the structure of the first driving component as shown in FIG. 3. In FIG. 3, the first switching unit is the first switching transistor, the first charging unit is the first capacitor, and the first driving unit is the first driving transistor, the first driving compensation unit comprises a first transistor, a second transistor and a third transistor. The first transistor is connected in parallel with the light-emitting device and has a strobe electrode connected to a first scanning control line. The second transistor is connected in series with the light-emitting device and has a strobe electrode connected to a first control line. The third transistor is connected between the second transistor and a second terminal of a first capacitor, and has a strobe electrode connected to a second control line. The details may make reference to the contents described in connection with FIG. 3.

In step S710, in the first period of time, the first driving compensation unit is used to charge the first charging unit based on the first power supply, so as to prepare for producing the threshold voltage at the first driving unit. In the circuit structure as shown in FIG. 3, the step S720 can be performed as follows: in the first period of time, a first scanning signal in the first scanning control line controls the first transistor to be turned on to bypass the light-emitting device so as to make the light-emitting device not emit light, a first control signal in the first control line and a second control signal in the second control line respectively control the second transistor and the third transistor to be turned on to charge the first charging unit, and thus the first driving unit is correspondingly turned on. In particular, respective devices are operated as follows to implement the step S710. The first scanning signal Vscan1 is at the high level, and thus the first switching transistor is turned on, and the voltage at the first terminal of the capacitor is equal to the low level of the first data signal Vdata1. The first transistor is turned on, and thus the light-emitting device becomes a short circuit. The first control signal is at the high level, and thus the second transistor is turned on. The second control signal in the second control line is at the high level, and thus the third transistor is turned on. Since the second transistor and the third transistor are turned on, the level Vdd of the first power supply is supplied to the gate of the first driving transistor (i.e., the second terminal of the capacitor), so that the first driving transistor is turned on and the first capacitor is charged.

In S720, the first driving compensation unit is used to discharge the first charging unit to produce a predetermined voltage comprising the threshold voltage of the first driving unit at the control terminal of the first driving unit. In the circuit structure as shown in FIG. 3, the step S720 can be performed as follows: in the second period of time, the first scanning signal controls the first transistor to be continually turned on, the first control signal controls the second transistor to be turned off, the second control signal controls the third transistor to be continually turned on, and the third transistor and the first driving unit form a loop to discharge the first capacitor until the first driving transistor is turned off, so that the predetermined voltage is produced at the strobe electrode of the first driving transistor. The predetermined voltage is equal to a sum of the threshold voltage of the first driving transistor and the voltage of the second power supply. In particular, respective devices are operated as follows to implement the step S720. The first control signal is at the low level, and thus the second transistor is turned off. The second control signal is at the high level, and thus the third transistor is continually turned on. The third transistor and the first driving transistor form a discharging loop, so that the voltage at the second terminal of the capacitor reduces from Vdd until the voltage is equal to Vth+Vss. The Vth+Vss is the predetermined voltage Vp. At this time, the first driving transistor is turned off and stops discharging; the first transistor T1 is turned on, and OLED is continually the short circuit and in a non-operation status; the first switching transistor is continually turned on.

In step S730, the first switching unit is turned on, transmits a level signal used for making the light-emitting device emit light and stores the level signal in the first charging unit. In the circuit structure as shown in FIG. 3, the step S730 can be performed as follows: in the third period of time, the first scanning signal controls the first transistor and the first switching unit to be continually turned on, the first control signal controls the second transistor to be continually turned off, the second control signal controls the third transistor to be turned off, and the first data signal in the first data line changes into a high level that makes the light-emitting device emit light and stores the high level in the first capacitor, so that the first driving transistor is turned on. In particular, respective devices may operate as follows to implement the step S730. The first control signal is at the low level, and thus the second transistor is turned off; the second control signal CT2 is at the low level, and thus the third transistor T3 is turned off; the second terminal of the first capacitor C1 is in a suspension state; the first scanning signal Vscan1 is at the high level, and thus the first transistor T1 is turned on and the light-emitting device is continually the short circuit to be in the non-operation state. The high level VH of the first data signal Vdata1 is written into the first terminal of the first capacitor C1, so that its voltage value is VH. Correspondingly, the voltage as shown in Equation (3) is produced at the gate of the first driving transistor, so as to realize voltage adjustment.

In the step S740, the first driving transistor is made to be turned on and the light-emitting device has the current flowing through it to emit light, so as to realize display. In the circuit structure as shown in FIG. 3, the step S740 can be performed as follows: in the fourth period of time, the first scanning signal controls the first transistor and the first switching unit to be turned off, the first control signal controls the second transistor to be turned on, the second control signal controls the third transistor to be turned off, the first driving unit is turned on until the fourth period of time ends up, and a turn-on of the first driving unit in the fourth period of time forms a loop for the light-emitting device, so as to make the light-emitting device emit light. The threshold voltage component in the predetermined voltage makes that the current flowing through the light-emitting device is independent of the threshold voltage when the light-emitting device emits light. The current flowing through the light-emitting device can make reference to the related content described in connection with the Equation (4). In the step S740, the first driving transistor and the turned-on second transistor form a path to make the light-emitting emit light, and the threshold voltage component in the predetermined voltage (for example, Vth+Vss) formed in the second period of time enables that the current flowing through the light-emitting device is independent of the threshold voltage when the light-emitting device emit light.

As described above, the light-emitting device does not emit light in the first period of time, the second period of time and the third period of time, and emits light in the fourth period of time for display. A sum of the first period of time, the second period of time and the third period of time is short relative to the fourth period of time, and is typically less than resolution time of the human eyes, thereby display effect of data is not affected. When the next frame period starts, operations in the above four periods of time are repeated.

In the above technical solution of the driving method according to the embodiment of the present disclosure, a predetermined voltage is produced at the strobe electrode of the driving unit by using the driving compensation unit, so that the current flowing through the light-emitting device is independent of the threshold voltage of the driving unit, the threshold voltage of the driving unit is prevented from affecting the light-emitting luminance of the light-emitting device, and luminance uniformity of the light-emitting device is guaranteed.

In addition, two groups of different driving components and a switch-over unit can be arranged for the light-emitting device, and the two groups of different driving components drive the light-emitting device at different time, so as to reduce operation time of the driving unit in each driving component. Thus, operation lifetime of the driving transistors may be increased, and correspondingly operation lifetime of the display panel may be increased. Correspondingly, the pixel driving circuit according to the embodiment of the present disclosure may further comprise: selecting one of the first driving component and the second driving component by the switch-over unit; using the first driving component to drive the light-emitting device when the first driving component is selected; and using the second driving component to drive the light-emitting device when the second driving component is selected.

The first driving component may comprise the first switching transistor, the first capacitor, the first driving transistor and the first driving compensation unit as shown in FIG. 3. The second driving component may have a structure similar to the first driving component, and may comprise the second switching transistor, the second capacitor, the second driving transistor and the second driving compensation unit corresponding to the first switching transistor, the first capacitor, the first driving transistor and the first driving compensation unit. The structures of the second driving compensation unit and the switch-over unit may be as shown in FIG. 5, and may make reference to the content described in connection with FIG. 5.

The second driving compensation unit may comprise a fourth transistor and a fifth transistor. The fourth transistor has strobe electrode connected to the second scanning control line, and a first electrode and a second electrode connected to the first terminal and the second terminal of the light-emitting device respectively. The fifth transistor has a strobe electrode connected to a third control line, a first electrode connected to the second terminal of the second transistor, and a second electrode connected to the strobe electrode of the second driving transistor, wherein the second driving component and the second transistor work together to drive the light-emitting device.

The switch-over unit comprises a first switch-over transistor and a second switch-over transistor. The first switch-over transistor has a strobe electrode connected to a first switch-over control line, a first electrode connected to the strobe electrode of the first driving transistor, and second electrode is connected to the second power supply. The second switch-over transistor has a strobe electrode connected to a second switch-over control line, a first electrode connected to the strobe electrode of the second driving transistor, and second electrode connected to the second power supply. At this time, the selecting one of the first driving component and the second driving component by the switch-over unit is as follows: driving the first switch-over transistor to be turned off by using a first switch-over control signal in the first switch-over control line and driving the second switch-over transistor to be turned on by using the second switch-over control signal in the second switch-over control line to disable the second driving unit, so as to select the first driving component; and driving the first switch-over transistor to be turned on by using the first switch-over control signal in the first switch-over control line, and driving the second switch-over transistor to be turned off by using the second switch-over control signal in the second switch-over control line to disable the first driving unit, so as to select the second driving component.

The structure of the switch-over unit as shown in FIG. 5 is just exemplary, and other structures and devices may be adopted according to the requirements to perform a switch-over control. In the case of different structures of the switch-over unit, other manners may be correspondingly adopted to select one of the first driving component and the second driving component to drive the light-emitting device.

In one frame period, by taking operation of the first driving component as an example, a first switch-over control signal in the first switch-over control line makes the first switch-over transistor to be turned off, and a second switch-over control signal in the second switch-over control line makes the second switch-over transistor to be turned on. The turn-on of the second switch transistor connect the strobe electrode of the second driving transistor to the second power supply that is at a low level, so that the second driving transistor is turned off and does not operate, and thus the second driving component does not operate. In order to increase the operation lifetime of driving unit, the light-emitting device may be driven by the first driving component in the odd frame period and driven by the second driving component in the even frame period. As an example, the driving method comprises: at a start of a first frame, selecting the first driving component by the switch-over unit, and performing the steps S710-S740 by using the first driving component to drive the light-emitting device to emit light until the first frame ends up; at a start of a second frame, selecting the second driving component by the switch-over unit, and performing the steps S710-S740 by using the second driving component to drive the light-emitting device to emit light until the second frame ends up; in a third frame, operations similar to the operations in the first frame are performed; in a fourth frame, operations similar to the operations in the second frame are performed, and so on and so forth. Such operations of alternately using the first driving component and the second driving component to control in the odd frames and the even frames may make reference to FIG. 6 and the content described in connection with FIG. 6.

Alternatively, one of the first driving component and the second driving component may be alternatively made to operate according to other manner of dividing time. Correspondingly, the timings for the first switch-over control signal and the second switch-over control signal in the switch-over unit are changed.

Operation time of the driving transistors in each deriving component may be reduced by using two different driving components to drive the light-emitting device, which thus may increase operation lifetime of the driving unit and correspondingly increase operation lifetime of the display panel.

Figure 8:
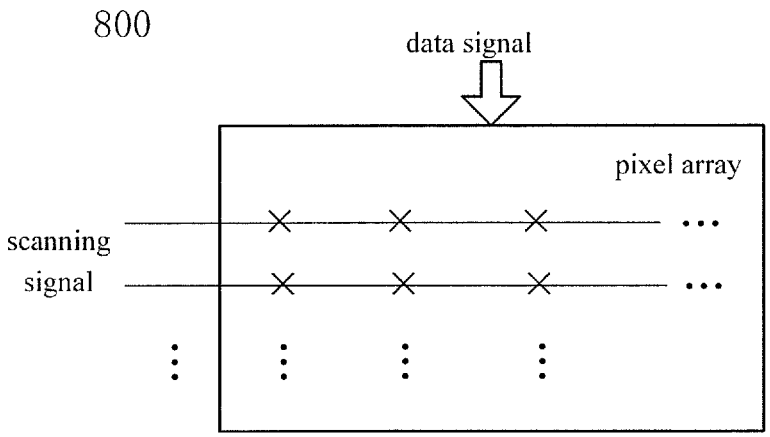
FIG. 8 schematically shows a block diagram of an array substrate according to an embodiment of the present disclosure.

The pixel driving circuit according to the embodiment of the present disclosure may be applied to a variety of devices or modules. FIG. 8 schematically shows a block diagram of an array substrate according to the embodiment of the present disclosure.

As shown in FIG. 8, the array substrate may comprise a pixel array and the pixel driving circuit for driving the light-emitting device according to the embodiment of the present disclosure. Each pixel in the pixel array comprises a light-emitting device. The pixel driving circuit according to the embodiment of the present disclosure is controlled according to the scanning control signal and writes the data signal for determining display luminance into the light-emitting device. FIG. 8 is just an exemplary structure of the array substrate, and may further comprise other components, such as a substrate and so on. Those skilled in the art may design an appropriate array substrate comprising the driving circuit according to the embodiment of the present disclosure according to requirement.

After a disclosure of the pixel driving circuit and the array substrate described above, any display device comprising the pixel driving circuit or the array substrate is fallen into the disclosure scope of the embodiments of the present disclosure. The display device may be for example an active matrix organic light-emitting diode AMOLED display.

In the technical solutions of the array substrate and the display device according to the embodiments of the present disclosure, due to the use of the pixel driving circuit as described above, it may also preventing the threshold voltage of the driving transistor from affecting the light-emitting luminance of the light-emitting device and guarantee luminance uniformity of the light-emitting device. Furthermore, in the case of using two driving components to alternately drive the light-emitting device, the operation lifetime of the display may be increased.

Those skilled in the art may clearly know that for the purpose of convenient and simple description, the specific implementation and structure of the pixel driving circuit to which the driving method described above is applied may make reference to the figures and operations in the embodiments of the pixel driving circuit described by combining with FIGS. 2, 3 and 4, and thus details are not given therein.

In the embodiments provided in the present disclosure, it should be understood that the circuit and method disclosed may be implemented in other ways. For example, the apparatus embodiments described above are just exemplary, and a part of steps in the method embodiments described above may be recombined.

The above descriptions are just particular implements of the present disclosure, but the protection scope of the present disclosure shall not be limited thereto. Those skilled in the art familiar with the technical field may easily conceive alternation or replacement within the technical scope disclosed in the present disclosure, which shall be covered within the protection scope of the present disclosure. Therefore, the protection scope of the present disclosure shall be subject to the protection scope of claims.

What is claimed is:

1. A pixel driving circuit comprising a first driving component and a second driving component, wherein the first driving component comprises:

a first switching unit, having a control terminal and a first terminal which are connected to a first scanning control line and a first data line respectively, and being configured to be turned on or turned off according to a first scanning signal in the first scanning control line to control a transmission of a data signal in the first data line, a first charging unit, having a first terminal which is connected to a second terminal of the first switching unit, a first driving unit, having a control terminal connected to a second terminal of the first charging unit, a first terminal connected to a first power supply through a light-emitting device, and a second terminal connected to a second power supply, a voltage of the first power supply being greater than a voltage of the second power supply, and the first driving unit being disabled when a voltage at the control terminal of the first driving unit is smaller than a threshold voltage, and a first driving compensation unit, connected to the control terminal of the first driving unit, and configured to produce a predetermined voltage at the control terminal of the first driving unit when the first scanning signal in the first scanning control line turns on the first switching unit, so that, after a data signal that enables to emit light is received from the first data line, a current flowing through the light-emitting device is independent of the threshold voltage of the first driving unit by means of the predetermined voltage, wherein the first driving compensation unit has a first control terminal connected to the first scanning control line, a second control terminal connected to a first control line and a third control terminal connected to a second control line, and wherein the second driving component comprises a second driving compensation unit having a first control terminal connected to a second scanning control line and a second control terminal connected to a third control line, and wherein the pixel driving circuit further comprises a first switch-over transistor, wherein a strobe electrode of the first switch-over transistor is connected directly to a first switch-over control line, a first electrode and a second electrode of the first switch-over transistor are connected directly to the control terminal of the first driving unit and the second power supply, respectively and a second switch-over transistor, wherein one of the first driving component and the second driving component is selected by using the first switch-over transistor and the second switch-over transistor;

the light-emitting device is driven by the first driving component when the first driving component is selected; and the light-emitting device is driven by the second driving component when the second driving component is selected.

2. The pixel driving circuit according to claim 1, wherein the first driving compensation unit comprises:

a first transistor, having a strobe electrode connected to the first scanning control line, a first electrode and a second electrode which are connected to the first terminal and the second terminal of the light-emitting device respectively;

a second transistor, having strobe electrode connected to the first control line, a first electrode connected to the second terminal of the light-emitting device, and a second electrode connected to a first electrode of the first driving unit; and a third transistor, having a strobe electrode connected to the second control line, a first electrode connected to a second terminal of the second transistor, and a second electrode connected to the control terminal of the first driving unit.

3. The pixel driving circuit according to claim 1, wherein the first switching unit comprises a first switching transistor, first switching transistor having a strobe electrode connected to the first scanning control line, a first electrode connected to the first data line, and a second electrode connected to the first terminal of the first charging unit.

4. The pixel driving circuit according to claim 1, wherein the first driving unit comprises a first driving transistor, the first driving transistor having a strobe electrode connected to a second terminal of the first charging unit, a first electrode connected to the first power supply through the light-emitting device, and a second electrode connected to the second power supply.

5. The pixel driving circuit according to claim 2, wherein the second driving component further comprises:

a second switching unit, having a control terminal and a first terminal which are connected to the second scanning control line and a second data line respectively and being configured to be turned on or turned off according to a second scanning signal in the second scanning control line to control a transmission of the data signal of the second data line, a second charging unit, having a first terminal connected to a second terminal of the second switching unit, and a second driving unit, having a control terminal connected to a second terminal of the second charging unit, first terminal connected to the first power supply via the light-emitting device, and a second terminal connected to the second power supply, wherein the a second driving compensation unit is further connected to the control terminal of the second driving unit, and is configured to produce a predetermined voltage at the control terminal of the second driving unit when the second scanning signal in the second scanning control line turns on the second switching unit, so that, after a data signal that enables to emit light is received from the second data line, the current flowing through the light-emitting device is independent of the threshold voltage of the second driving unit by means of the predetermined voltage.

6. The pixel driving circuit according to claim 5, wherein the second driving compensation unit comprises:

a fourth transistor, having a strobe electrode connected to the second scanning control line, a first electrode and second electrode which are connected to the first terminal and the second terminal of the light-emitting device respectively; and a fifth transistor, having a strobe electrode connected to the third control line, a first electrode connected to the second terminal of the second transistor, and a second electrode connected to the control terminal of the second driving unit, wherein the second driving component and the second transistor cooperate to drive the light-emitting device.

7. The pixel driving circuit according to claim 6, wherein the pixel driving circuit further comprises:

a second switch-over transistor, having a strobe electrode connected to a second switch-over control line, a first electrode connected to a strobe electrode of the second driving transistor, and a second electrode connected to the second power supply.

8. The pixel driving circuit according to claim 7, wherein the first driving component drives the light-emitting device to emit light in an odd frame period, and the second driving component drives the light-emitting device to emit light in an even frame period, in the odd frame period, the first switch-over transistor is turned off under a driving of a first switch-over control signal in the first switch-over control line, and the second switch-over transistor is turned on under a driving of the second switch-over control signal in the second switch control line to disable the second driving transistor; and in the even frame period, the first switch-over transistor is turned on under a driving of a first switch-over control signal in the first switch-over control line, and the second switch-over transistor is turned off under a driving of the second switch-over control signal in the second switch control line to disable the first driving transistor.

9. A driving method for a pixel driving circuit, wherein the pixel driving circuit is configured to drive a light-emitting device and comprising a first driving component and a second driving component, wherein the first driving component comprising a first switching unit, a first charging unit, a first driving unit and a first driving compensation unit, the first switching unit having a control terminal connected to a first scanning control line, a first terminal connected to a first data line, and a second terminal connected to a first terminal of the first charging unit, the first driving unit having a control terminal connected to a second terminal of the first charging unit, a first terminal connected to a first power supply via the light-emitting device, and a second terminal connected to a second power supply, a voltage of the first power supply being greater than a voltage of the second power supply, the first driving compensation unit being connected to a control terminal of the first driving unit, the first driving unit being disabled when a voltage at the control terminal of the first driving unit is smaller than a threshold voltage, and each frame period driven by the pixel driving circuit being divided into a first period of time, a second period of time, a third period of time and a fourth period of time in sequence, wherein the first driving compensation unit has a first control terminal connected to the first scanning control line, a second control terminal connected to a first control line and a third control terminal connected to a second control line, and wherein the second driving component comprises a second driving compensation unit having a first control terminal connected to a second scanning control line and a second control terminal connected to a third control line, and wherein the pixel driving circuit further comprises a first switch-over transistor and a second switch-over transistor, wherein a strobe electrode of the first switch-over transistor is connected directly to a first switch-over control line, a first electrode and a second electrode of the first switch-over transistor are connected directly to the control terminal of the first driving unit and the second power supply, respectively, the driving method comprises selecting one of the first driving component and the second driving component by using the first switch-over transistor and the second switch-over transistor;

driving the light-emitting device by the first driving component when the first driving component is selected; and driving the light-emitting device by the second driving component when the second driving component is selected, wherein in case where the first driving components is selected, the driving method comprises charging the first charging unit by means of the first driving compensation unit in the first period of time, discharging the first charging unit by means of the first driving compensation unit until a predetermined voltage is produced at the control terminal of the first driving unit in the second period of time, the predetermined voltage including a threshold voltage component of the first driving unit, turning on the first switching unit and transmitting a level signal used for making the light-emitting device emit light and storing the level signal in the first charging unit in the third period of time, and turning on the first driving unit to form a loop for the light-emitting device so as to make the light-emitting device emit light in the fourth period of time, the threshold voltage component in the predetermined voltage making that a current flowing through the light-emitting device is independent of the threshold voltage when the light-emitting device emits light.

10. The driving method according to claim 9, wherein the first driving compensation unit comprises a first transistor, a second transistor and a third transistor, the first transistor being connected in parallel with the light-emitting device and having a strobe electrode connected to a first scanning control line, the second transistor being connected in series with the light-emitting device and having a strobe electrode connected to a first control line, and the third transistor being connected between the second transistor and a second terminal of a first capacitor, and having a strobe electrode connected to a second control line, the charging the first charging unit by means of the first driving compensation unit in the first period of time comprising: in the first period of time, controlling the first transistor to be turned on by a first scanning signal in the first scanning control line to form a bypass for the light-emitting device, to not make the light-emitting device emit light, controlling the second transistor and the third transistor to be turned on to charge the first charging unit by a first control signal in the first control line and a second control signal in the second control line respectively, and correspondingly turning on the first driving unit, the discharging the first charging unit by means of the first driving compensation unit until the predetermined voltage is produced at the control terminal of the first driving unit in the second period of time comprising: in the second period of time, controlling the first transistor to be continually turned on by the first scanning signal, controlling the second transistor to be turned off by the first control signal, controlling the third transistor to be continually turned on by the second control signal, and the third transistor and the first driving unit forming a loop to make the first charging unit discharge until the first driving unit is disabled, so that the predetermined voltage is produced at the control terminal of the first driving unit, the predetermined voltage being equal to a sum of the threshold voltage of the first driving unit and the voltage of the second power supply.

11. The driving method according to claim 10, wherein, the turning on the first switching unit and transmitting a level signal used for making the light-emitting device emit light and storing the level signal in the first charging unit in the third period of time comprises: in the third period of time, controlling the first transistor and the first switching unit to be continually turned on by the first scanning signal, controlling the second transistor to be continually turned off by the first control signal, controlling the third transistor to be turned off by the second control signal, and the first data signal in the first data line changing into a high level that makes the light-emitting device emit light, and storing the high level in the first charging unit, so as to turn on the first driving unit, the turning on the first driving unit to form a loop for the light-emitting device so as to make the light-emitting device emit light in the fourth period of time comprises: in the fourth period of time, controlling the first transistor and the first switching unit to be turned off by the first scanning signal, controlling the second transistor to be turned on by the first control signal, controlling the third transistor to be turned off by the second control signal, turning on the first driving unit until the fourth period of time ends up, and a turn-on of the first driving unit in the fourth period of time forming a loop for the light-emitting device to make the light-emitting device emit light.

12. The driving method according to claim 9, wherein a strobe electrode of the second switch-over transistor being connected to a second switch-over control line, a first electrode thereof being connected to a control terminal of the second driving unit, and a second electrode thereof being connected to the second power supply, the selecting one of the first driving component and the second driving component by using the first switch-over transistor and the second switch-over transistor comprising:

driving the first switch-over transistor to be turned off by a first switch-over control signal in the first switch-over control line, and driving the second switch-over transistor to be turned on by the second switch-over control signal in the second switch-over control line to stop using the second driving unit, so as to select the first driving component; and driving the first switch-over transistor to be turned on by the first switch-over control signal in the first switch-over control line and driving the second switch-over transistor to be turned off by the second switch-over control signal in the second switch-over control line to stop using the first driving unit, so as to select the second driving component.

13. The driving method according to claim 9, wherein, the driving the light-emitting device by the first driving component comprises: driving the light-emitting device by the first driving component in an odd frame period;

the driving the light-emitting device by the second driving component comprises: driving the light-emitting device by the second driving component in an even frame period.

14. An array substrate, comprising the pixel driving circuit according to claim 1.

15. A display device, wherein comprising the array substrate according to claim 14.

* * * * *